US007338006B2

(12) United States Patent
Gelli et al.

(10) Patent No.: US 7,338,006 B2
(45) Date of Patent: Mar. 4, 2008

(54) REWINDING MACHINE AND METHOD FOR THE PRODUCTION OF LOGS, WITH MEANS TO CONTROL THE FINAL DIAMETER OF THE LOGS

(75) Inventors: Mauro Gelli, Lucca (IT); Sergio Gaertner, Joinville (BR)

(73) Assignee: Fabio Perini S.p.A., Lucca (IT)

( * ) Notice: Subject to any disclaimer, the term of this patent is extended or adjusted under 35 U.S.C. 154(b) by 281 days.

(21) Appl. No.: 10/505,108

(22) PCT Filed: Jan. 12, 2004

(86) PCT No.: PCT/IT2004/000005

§ 371 (c)(1),
(2), (4) Date: Aug. 19, 2004

(87) PCT Pub. No.: WO2004/063067

PCT Pub. Date: Jul. 29, 2004

(65) Prior Publication Data

US 2005/0103920 A1 May 19, 2005

(30) Foreign Application Priority Data

Jan. 15, 2003 (IT) ..... FI2003A0009

(51) Int. Cl.
*B65H 18/14* (2006.01)

(52) U.S. Cl. ..... 242/541.6; 242/542.2; 242/547

(58) Field of Classification Search ..... 242/541.5, 242/541.6, 542, 542.2, 547
See application file for complete search history.

(56) References Cited

U.S. PATENT DOCUMENTS 4,811,915 A 3/1989 Smith
5,267,703 A 12/1993 Biagiotti
6,129,305 A 10/2000 Möller et al.

*Primary Examiner*—John Q. Nguyen
(74) *Attorney, Agent, or Firm*—Breiner & Breiner, LLC

(57) ABSTRACT

The rewinding machine comprises a winding roller (5) equipped with a moving axis to remain in contact with a log (R) being formed and allow the diameter of said log to increase. A member to control the action of said roller on the log (R) being formed is associated with the winding roller with moving axis. The control member is provided with a stop position that can be set to be reached before winding of the log (R) is completed. Winding of the log being formed is essentially completed without moving the axis of the winding roller with moving axis (5) in order to obtain a finished log always with a more or less constant diameter.

19 Claims, 4 Drawing Sheets

REWINDING MACHINE AND METHOD FOR THE PRODUCTION OF LOGS, WITH MEANS TO CONTROL THE FINAL DIAMETER OF THE LOGS

TECHNICAL FIELD

The present invention relates to a rewinding machine and more specifically to a surface rewinding machine, of the continuous type or of the start-stop type. In surface winding machines the web material is wound by maintaining the log in rotation in the forming phase through frictional force transmitted by winding members forming a winding cradle.

More specifically, the present invention relates to a rewinding machine of the type comprising a winding cradle constituted by winding rollers and specifically comprising at least one roller with a moving axis that is maintained in contact with the log being formed and gradually moved away from the axis of the log to allow it to increase in diameter.

The invention also relates to a method for producing logs of web material.

As shall become apparent hereunder, the invention can be applied both in the forming of logs with central cores or central winding spindles and of logs without central winding cores.

BACKGROUND OF THE INVENTION

Surface rewinding machines are currently used to produce logs of web material, in particular, although not exclusively, paper such as tissue paper, for example toilet tissue, kitchen paper and the like. In these machines the log being formed is made to rotate through the effect of winding members in peripheral contact with the log. Typically, these winding members are rollers or, in some cases, belts or combinations of rollers and belts.

Surface winding machines may be of the continuous type, that is in which the web material is fed continuously and at an essentially constant speed, even during the exchange phase. This is the phase during which the web material is severed, the completed log is unloaded from the winding cradle and winding of a new log commences in the winding cradle. Surface winding machines can also be of the start-stop or discontinuous type. In this type feed of the web material is interrupted during the exchange phase.

The logs formed in rewinding machines are subsequently cut into rolls of a smaller axial length and these are packaged, normally in multiple packages, to be sold.

One of the critical aspects when forming logs is control of the diameter and the quantity of wound material. In fact, in order to allow correct operation of packaging machines the logs, and therefore the rolls obtained from them, must have more or less the same diameter, i.e. coming within a relatively narrow range of tolerance. Excessive variations in the diameter of logs causes problems and blocking during subsequent packaging of the rolls.

Moreover, each roll must contain a minimum quantity of web material, equivalent to the quantity declared on the packaging. If the quantity is below the one declared sellers and manufacturers could be reported for fraud. A quantity above the nominal amount causes economic losses for the manufacturer.

Therefore, winding of logs must be controlled so that their external diameter does not differ significantly from the nominal value, obtained with a predetermined quantity of wound material or slightly above said predetermined quantity.

While in the most advanced and more costly rewinding machines these parameters are controlled accurately with sophisticated electronic systems, a problem often occurs in less costly machines equipped with limited control systems in that having set the length of the web material wound on each log, the external diameters of the various logs differ greatly. This depends on variations in thickness to which paper (especially tissue paper) is subject by nature.

U.S. Pat. No. 5,267,703 describes a rewinding machine with a winding roller with moving axis associated with a member to control movement of the roller, to ensure that a diameter contained within a predetermined range of tolerance is obtained, with a preestablished quantity of wound web material. This machine is efficient and has a limited cost. Nonetheless, it is still too sophisticated for some types of market also on account of the diameter control system used.

OBJECTS AND SUMMARY OF THE INVENTION

The object of the present invention is to provide a rewinding machine that allows logs with sufficiently uniform diameters (i.e. falling within a restricted range of variation) to be obtained without sophisticated control systems being required.

Essentially, this and other objects and advantages, which shall become apparent to those skilled in the art from reading the text hereunder, are obtained with a surface rewinding machine with a winding roller with moving axis, associated with a pair of actuators that control movement of the roller. According to the invention, the two actuators are connected to each other. One of said actuators controls movement of the winding roller axis during increase in the log being formed, and has a position (especially, for example, a stroke end position of a piston of a piston-cylinder actuator) that corresponds to the dimension of the final diameter of the log being formed. The second actuator, on the other hand, is used to impart movement to the winding roller with moving axis to move it away from the completed log to allow unloading.

With an arrangement of this type during formation of the log in the winding cradle the winding roller with moving axis is gradually lifted and moved away from the remaining members forming the winding cradle, for example a further pair of winding rollers. Gradual lifting is caused by the log being formed, which increases in diameter. Before the entire quantity of web material has been wound, movement of the winding roller with moving axis is stopped, the actuator controlling it reaching its stroke end position. Winding of the final portion of web material takes place with increased pressure on the log, which can no longer increase in diameter. This means that the final turns of wound material are tighter and more compact. This does not cause particular drawbacks and, moreover, ensures that the dimension of the diameter of the finished log comes within a relatively limited range of tolerance that will not cause problems during subsequent handling and in particular during final packaging of the rolls obtained from cutting the logs. In some cases the presence of a certain number of external turns wound more compactly may even be an advantage, as it protects the log from possible mechanical strains. This is particularly true in the case of soft logs, which are wound with limited compactness.

The number of turns wound around the log after the roller with moving axis stops depends on how the previous turns were wound. The slacker the previous turns are, the greater the quantity of web material still to be wound after the log reaches its predetermined final diameter will be. The more compact winding, performed before the gradual lifting movement of the winding roller with moving axis stops, is, the fewer the number of turns still to be wound around the log in conditions of greater winding pressure, and therefore with increased compactness, will be.

As movement of the winding roller with moving axis is advantageously stopped by bringing the first actuator to its stroke end, the subsequent movement in the same direction required to move the winding roller away from the completed log and allow the latter to be unloaded from the winding roller is obtained with the second actuator.

In more general terms, the invention is based on the idea of controlling the action of the winding roller with moving axis on the log being formed by means of a control member characterized by a stop position, that is a position in which it stops further movement of the winding roller axis. This position is reached before the log is finished, that is before the desired quantity of web material has been wound on it. Consequently, the remaining quantity of web material to be wound will be wound on the log essentially preventing it from increasing in diameter.

This idea may also be implemented with a single actuator, rather than two combined actuators, for example by providing a system to stop movement of the roller with moving axis when the aforesaid position has been reached.

Movement of the axis of the moving winding roller, also called pressing roller, may be a translatory movement. In a preferred embodiment of the invention, nonetheless, the winding roller with moving axis is supported by a pair of oscillating arms. Its movement will therefore be one of rotation about a fixed axis.

While the use of rotary actuators is not excluded, according to a particularly advantageous embodiment of the invention the two actuators are linear actuators, preferably mounted aligned with each other. For example, two piston-cylinder actuators may be used, advantageously of the pneumatic type, especially if in counter-pressure, connected rigidly to each other. Although, for example, it is possible to connect the rod of one of said actuators rigidly to the cylinder of the other, a particularly simple and mechanically ideal configuration is obtained by rigidly connecting the two cylinders of the two actuators to each other. These may be placed side by side and blocked together. Nonetheless, the two cylinders are preferably abutted with each other with the back parts in contact and blocked against each, other. In this way a double linear actuator is obtained, which is particularly compact and of simple construction. A system with a double piston-cylinder actuator may also be constituted (rather than by two cylinders mounted together) by a single cylinder inside which two pistons slide.

The two piston-cylinder actuators, joined to each other, form an assembly that may be hinged, by the two opposed rods of the two actuators, respectively to at least one of the oscillating supporting arms of the winding roller with moving axis and to a fixed point of the machine structure.

To allow the machine to produce logs with diameters of various dimensions, and maintain the aforesaid advantage regarding tolerance on the effective diameter of the various logs, it is advantageous for the position of the winding roller with moving axis at the end of winding to be adjustable, although with the first actuator always reaching the same stroke end position in these conditions. For this purpose, for example, a tie-rod with adjustable dimensions may be associated with the actuators. The position of the winding roller with moving axis when the first actuator reaches its stroke end position is adjusted by adjusting the length of the tie-rod. The tie-rod may advantageously be associated with the rod of the second piston-cylinder actuator.

According to a different aspect, the object of the present invention is to provide a simple method for producing logs of web material, with sufficiently uniform diameters for the purposes of subsequent packaging operations.

Essentially, according to this aspect, the invention provides a winding method wherein just before winding of each log is completed, movement of the axis of the moving winding roller is stopped, before a predetermined quantity of web material has been wound on the log and wherein winding of the web material is completed maintaining the winding roller in an essentially fixed position. Normally, upon reaching the stop position of the roller with moving axis, the roller carries out a further opening movement to unload the log, although unloading of the log may also take place in another way, for example by moving a different member defining the winding cradle.

Further advantageous characteristics and embodiments of the method and of the machine according to the invention are indicated in the attached dependent claims.

BRIEF DESCRIPTION OF THE DRAWINGS

The invention shall now be better understood by following the description and accompanying drawing, which schematically shows a non-limiting practical embodiment of the invention. In the drawing, in which equivalent parts are indicated with the same reference numerals.

DETAILED DESCRIPTION OF AN EMBODIMENT OF THE INVENTION

In the attached drawing the invention is shown applied to a rewinding machine of the start-stop, that is discontinuous, type, wherein the feed of web material towards the winding cradle is stopped at the end of winding each log. However, as shall be apparent from the description hereunder, it must be understood that the invention may also be applied to a machine of the continuous type, that is in which the web material is fed continuously without stopping also during the exchange phase, i.e. the phase to unload a finished log and start winding a new log.

Only the components of the rewinding machine essential to understanding the present invention are indicated, as these machines are per se known.

Figure 1:
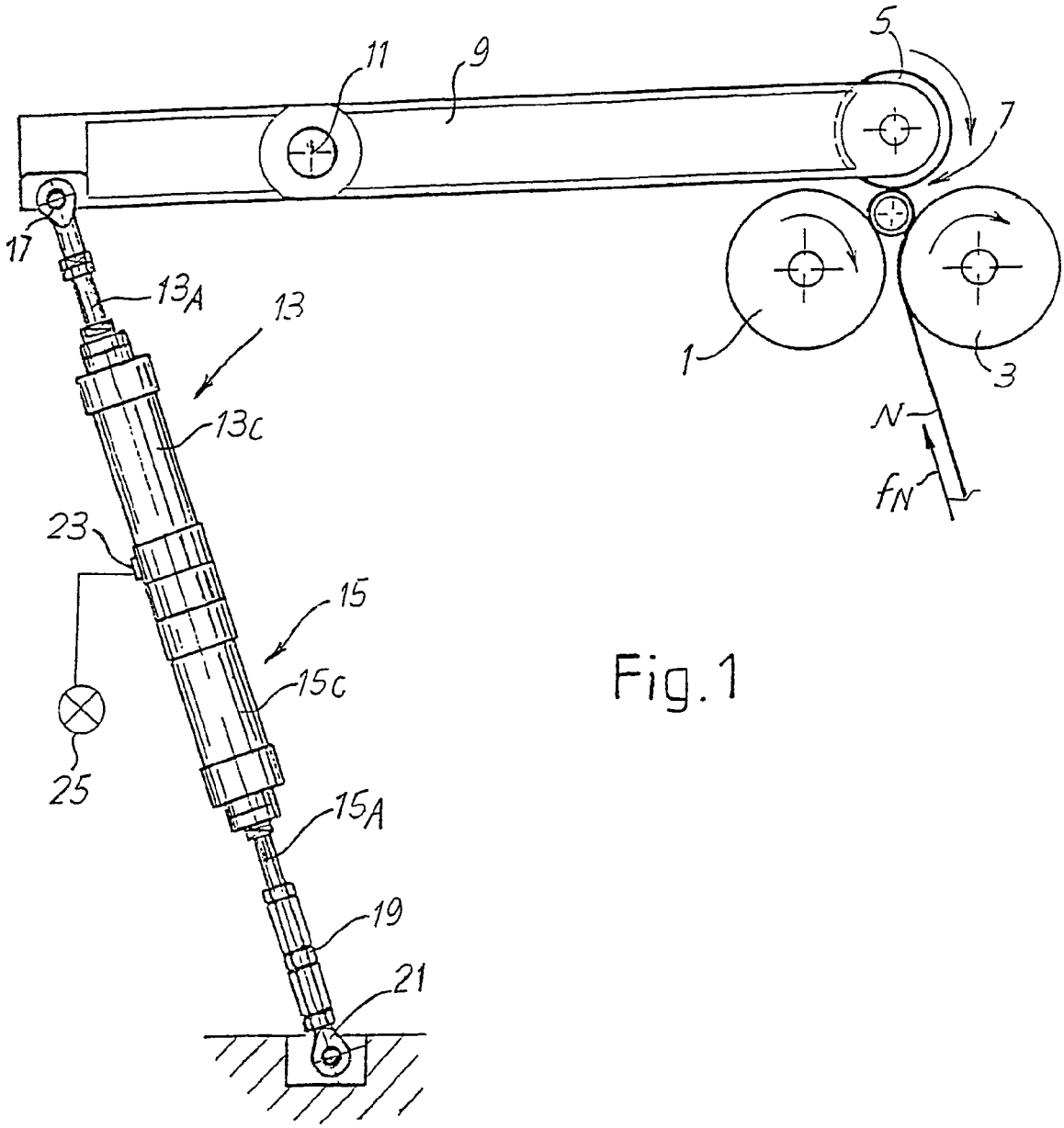
FIGS. 1 to 3 show three distinct and successive positions of the winding members during the winding cycle of a log.
Figure 2:
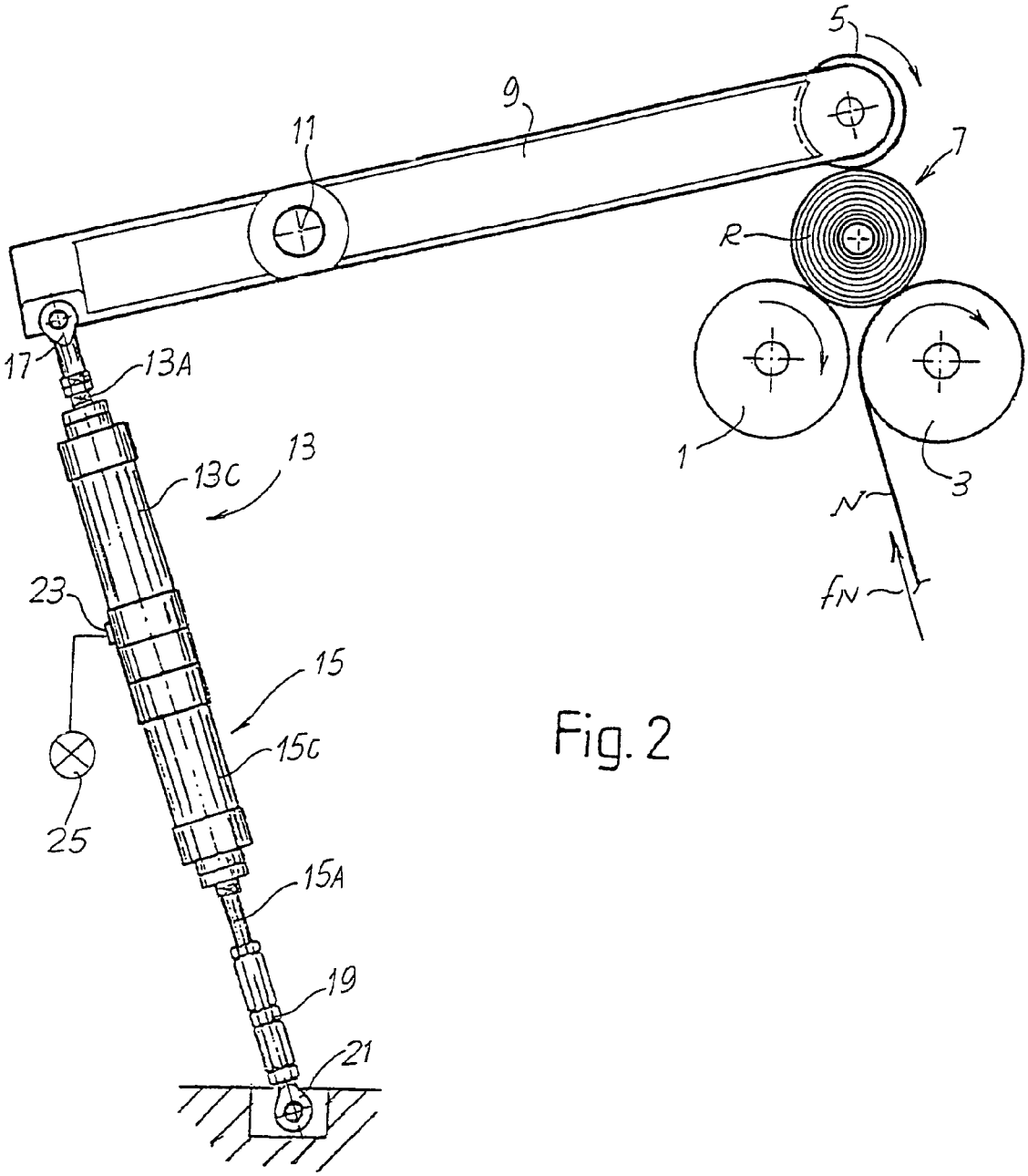
Figure 3:
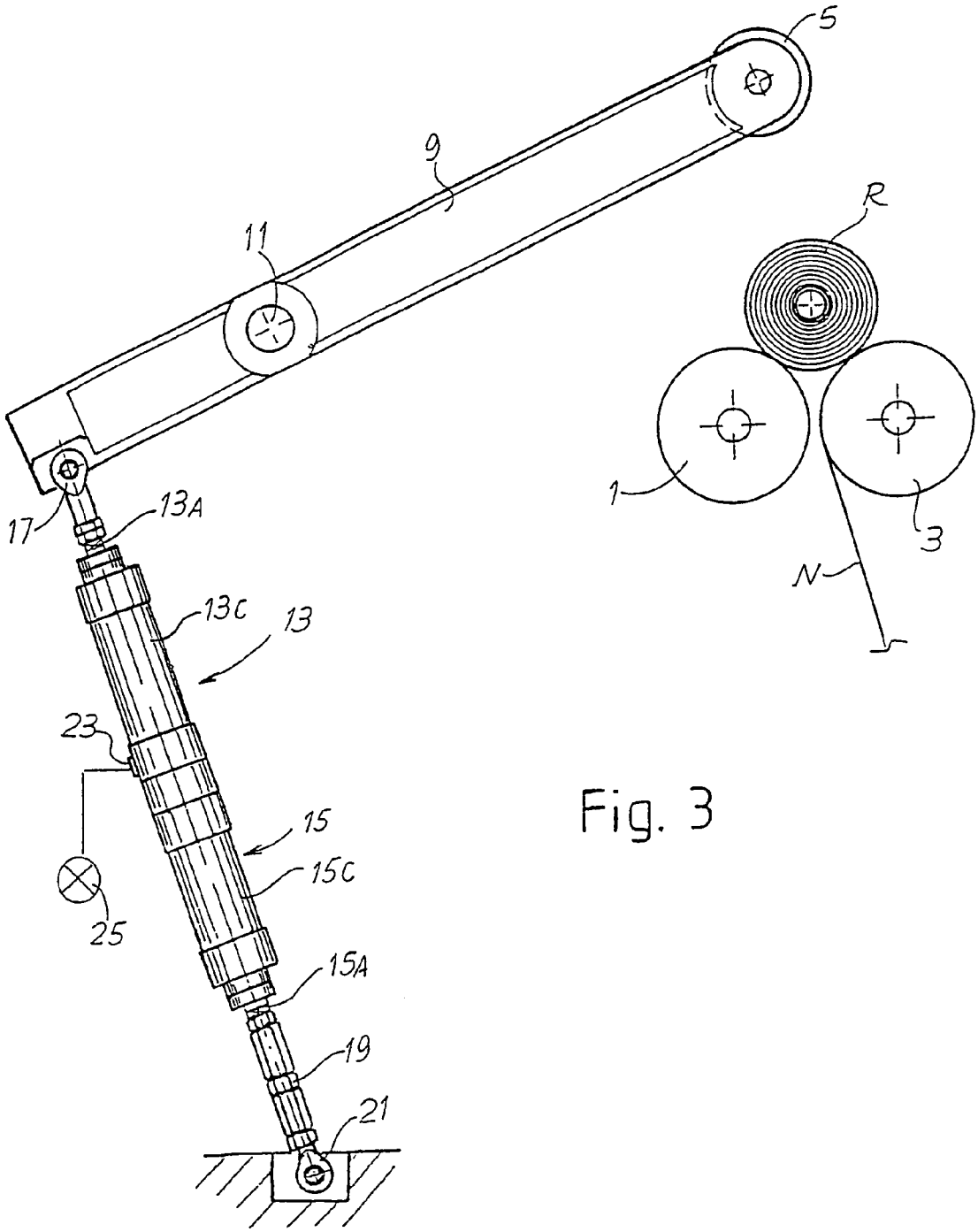

With initial reference to FIGS. 1 to 3, the rewinding machine comprises a first and a second winding roller 1, 3 with parallel axes and defining, with a third winding roller 5, a winding cradle 7. While the winding rollers 1 and 3 have (in this example): a fixed axis, the third winding roller 5 is carried by a pair of oscillating arms 9 hinged about an oscillation axis 11. Therefore, the axis of the third winding roller 5 is moving so that the roller 5 can move away from and towards the rollers 1 and 3.

The oscillatory movement of the oscillating arms 9 is controlled by a pair of piston-cylinder actuators 13 and 15, of which 13C and 15C indicate the cylinders and 13A and 15A indicate the rods of the respective pistons. The two piston-cylinder actuators 13, 15 are aligned and connected rigidly with each other at the back ends of the respective cylinders 13C, 15C.

The rod 13A of the actuator 13 is hinged in 17 to one of the arms 9, on the opposite side of the roller 5 in respect of the oscillation axis 11. The rod 15A is connected, by means of a tie-rod with adjustable length 19, to a fixed point 21 of the machine structure, not shown in detail.

A sensor 23 equipped with an indicator 25, for example a lamp, is associated with the piston-cylinder 13. This sensor detects the stroke end position, that is of maximum retraction, of the actuator 13, for the purposes described herein.

Operation of the machine described hereinbefore is as follows: FIG. 1 shows the initial phase of winding of a first log R of web material N. A few turns of material N are wound around the winding core or spindle, the outermost of which is in contact with the three rollers 1, 3, 5, which may all advantageously be motorized, although other solutions, such as one idle roller, are possible. The roller 5 is pressed against the log being formed with a pressure determined by the pressure of the fluid inside the actuator 13. This pressure may suitably be maintained more or less constant or (when the machine has a more complex configuration) may vary during winding, for example as a function of the angular position of the pair of oscillating arms 9. In general, the force applied by the actuator 13 partly compensates the weight of the roller 5, so that the stress applied to the log being formed is lower than the stress that would be applied by the overall weight of the roller 5. In any case, the assembly 13, 15 controls action of the winding roller 5 on the log being formed, in the sense that through it stress that can be determined and adjusted according to production needs is applied to the log.

FIG. 2 shows a conclusive phase of winding. The log R has increased in diameter and consequently the arms 9 have rotated counter-clockwise (in the drawing) to allow lifting of the winding roller 5 with moving axis. The piston-cylinder actuator 13 has retracted to allow this movement, while the actuator 15 has remained completely extended. FIG. 2 shows the completely retracted position of the piston cylinder actuator 13. Nonetheless, winding of the log R is still not complete, as the set quantity of web material has not yet been reached. The final turns of web material N are wound maintaining the roller 5 in the position in FIG. 2 and thus effectively preventing an increase in the diameter of the log R. These final turns will therefore be wound with increased compactness in respect of the previous ones. The length of web material wound on the log may be measured in any known way, for example by an encoder on one of the rollers around which the web material is driven.

In FIG. 3 the log being formed R has been completed. To allow the exchange phase, that is unloading the finished log R and introducing a new winding core into the winding cradle 7 among other things, the moving winding roller 5 must be lifted further in respect of the position in FIG. 2. The actuator 15 is used for this purpose. As can be seen in FIG. 3, retraction, of the actuator 15 causes further lifting of the roller 5, thus allowing unloading of the completed log R from the cradle 7. Operations to cut or sever the web material, unload the log, insert the new winding core and adhesion of the initial free end to the new core to start winding a subsequent log are not described in detail as these may take place in any way known to those skilled in the art.

Following the exchange phase a new log starts to be wound with the same procedures described herein.

It may be necessary to change the quantity of web material wound on each log R, or the density of winding, modifying the pressure applied by the roller 5 on the log being formed with consequent variation in the compactness of winding the various turns. By varying these parameters the diameter of the final log obtained changes. For example, if it is desired to obtain less compact logs with the same length of material wound, the pressure inside the cylinder 13C of the actuator 13 will be increased, in order to reduce the weight of the roller 5 on the log being formed. Consequently, the final diameter of the logs will increase. On the other hand, it may be desirable to wind a greater quantity of web material N on each log R with the same winding density, with a consequent increase in the final diameter.

As the final diameter is set by the stroke end position of the actuator 13, the adjustable tie-rod 19 is provided to allow modification of these winding parameters. If it is desired to wind a larger quantity of web material and/or to obtain less compact winding and, therefore, to reach larger final winding diameters, the tie-rod 19 is shortened, so that the final position of the winding roller 5 when the actuator 13 has reached its stroke end position will be higher, that is farther from the winding rollers 1 and 3.

The sensor 23 and the indicator 25 are provided to facilitate setting of the machine by adjusting the length of the tie-rod 19, with regard to the final diameter of the log. The sensor 23 and the indicator 25 may be used in combination or alternatively to modify the operating conditions of the machine with regard to winding compactness, which is set and modified by acting on the pressure value inside the cylinder 13C.

The sensor 23 and the indicator 25 inform the operator when the actuator 13 has reached is stroke end position and therefore when the final diameter of the log R has been reached (layout in FIG. 2). The operator can tell, for example by means of a counter or a suitable interface known per se, how much web material has been wound at the time in which this stroke end position is reached and how much material must still be wound in the final turns. If the operator sees that with the winding parameters set (thickness of the web material N, winding pressure, length of material to be wound), the stroke end position of the actuator 13 and hence the final diameter are reached too soon and therefore too many external turns of the log will be wound very compactly, the operator will shorten the tie-rod 19. An inverse lengthening operation will be performed in the opposite situation; that is, for example, if the quantity of web material wound is inadequate to attain the final diameter of the log.

When the set quantity of web material is attained without the moving roller 5 having reached the final position and therefore the completed log has not reached the diameter set for correct packaging, the operator will increase the pressure value inside the cylinder 13C.

Figure 4:
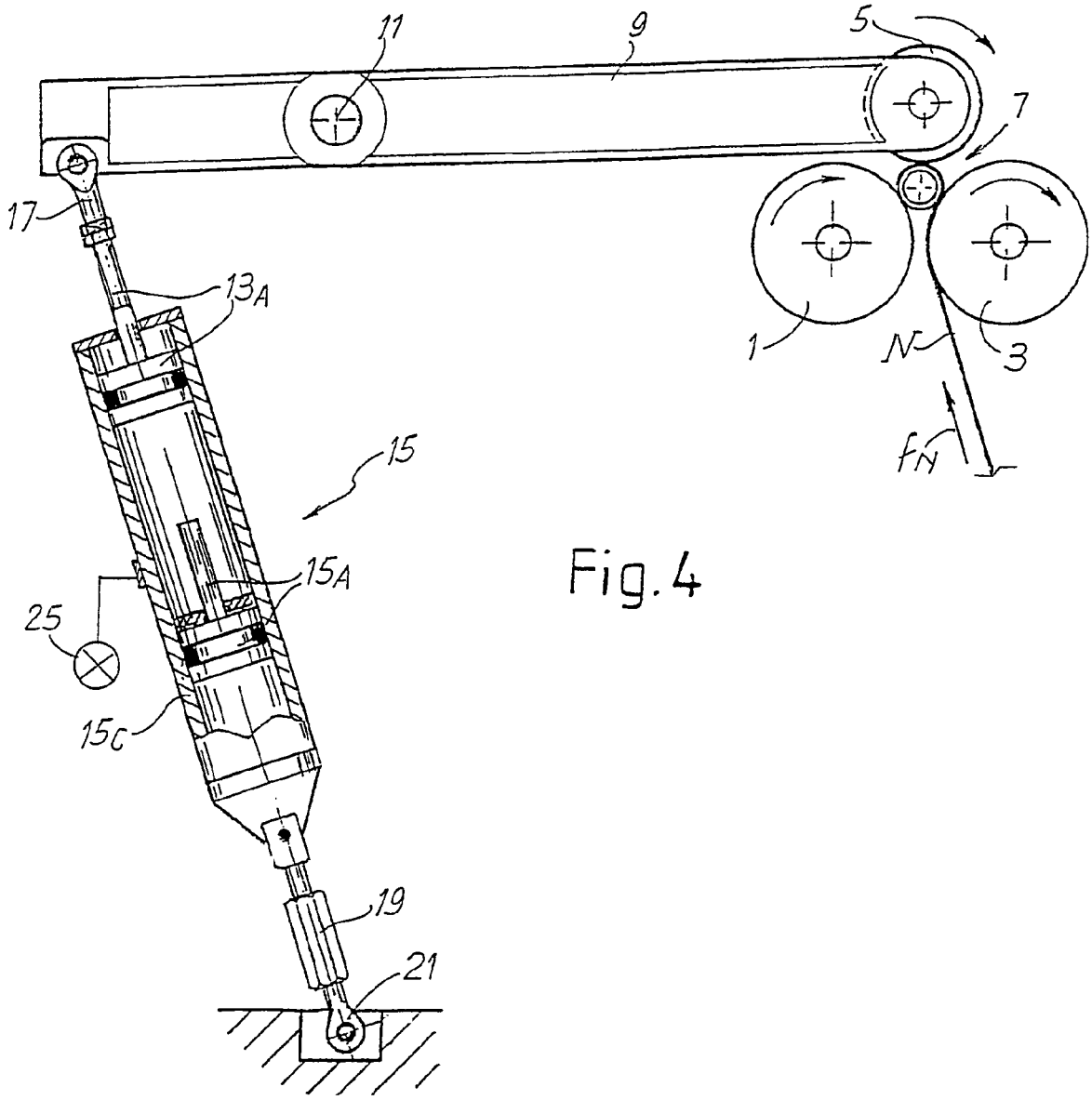
FIG. 4 shows a different embodiment.

FIG. 4 shows a modified embodiment, wherein equivalent or corresponding parts are indicated with the same reference numerals used in FIGS. 1 to 3. In this case, the two actuators that control movement of the winding roller 5 are constituted by a single cylinder 15, inside which two pistons 13A, 15A slide, each equipped with a respective rod. From the position in FIG. 4, the roller 5 is lifted during winding of the log and increase of its diameter, with retraction of the piston 13A inside the cylinder 15C. The stroke end position is defined by the position of the rod of the piston 15A. When this position is reached, the log is completed and can be unloaded by moving the roller 5 farther from the rollers 1 and 3 through simultaneous retraction of the two pistons 13A, 15A inside the cylinder 15C.

The arrangement of the actuators—or in general of the control member of the roller with moving axis—may differ from the one illustrated. For example, the actuators may be disposed above rather than below the oscillating arm 9 and/or can be hinged in an intermediate point between the axis of the roller 5 and the axis of oscillation of the arm. Consequently, the stroke end positions will differ.

It is understood that the drawing purely shows a practical embodiment of the invention, the forms and arrangements of which may vary without however departing from the scope of the concept underlying the invention. Any reference numerals in the attached claims are provided purely to facilitate reading in the light of the description hereinbefore and of the attached drawings and do not limit the scope of protection whatsoever.

The invention claimed is:

1. A surface rewinding machine for producing logs of web material, with a winding cradle comprising at least one winding roller equipped with a moving axis to remain in contact with a log being formed in said cradle and allow a diameter of said log to increase, a control member to control action of said winding roller on the log being formed which is associated with said winding roller with moving axis, wherein said control member is provided with a stop position that can be set to be reached before the log has been completely wound, winding of the log being formed being completed substantially without moving the axis of the winding roller with moving axis, and wherein a first actuator and a second actuator are connected to each other end-to-end and are associated with said winding roller with moving axis, the first actuator controlling the action of the winding roller on the log being formed in said winding cradle during increase in the log, a stroke end position of said first actuator corresponding to a dimension of a final diameter of the log being formed; and the second actuator imparting a movement to the winding roller with moving axis to move the winding roller away from the completed log.

2. Rewinding machine as claimed in claim 1, wherein said first actuator and said second actuator are composed of a common cylinder and of two pistons sliding in said cylinder.

3. Rewinding machine as claimed in claim 1, wherein said first actuator and said second actuator are linear actuators, mounted aligned with each other.

4. Rewinding machine as claimed in claim 1 or 3, wherein said first actuator and said second actuator are constituted by two piston-cylinder actuators rigidly connected to each other.

5. Rewinding machine as claimed in claim 4, wherein said two piston-cylinder actuators form an assembly hinged, by two opposed rods of pistons of the first actuator and the second actuator, respectively, to at least one of said arms supporting the winding roller with moving axis, and to a fixed point of the machine.

6. Rewinding machine as claimed in claim 1, 2 or 3, wherein the first actuator has a stroke end position corresponding to the dimension of the final diameter of the log being formed, and is a position of maximum retraction of the first actuator.

7. Rewinding machine as claimed in claim 6, wherein a detector is associated with said first actuator, to produce a signal when the first actuator reaches said stroke end position.

8. A surface rewinding machine for producing logs of web material, with a winding cradle comprising at least one winding roller equipped with a moving axis to remain in contact with a log being formed in said cradle and allow a diameter of said log to increase, a control member to control action of said winding roller on the log being formed which is associated with said winding roller with moving axis, wherein said control member is provided with a stop position for said winding roller with moving axis that can be set to be reached before the log has been completely wound, to provide that winding of the log being formed is completed while the moving axis of the winding roller is in an essentially fixed position, wherein the stop position of the winding roller with moving axis at an end of winding is adjustable, wherein a tie-rod of adjustable length is associated with said control member, and wherein a first actuator and a second actuator forming a part of said control member are associated with said winding roller and said first actuator and said second actuator are composed of a common cylinder and of two pistons sliding in said cylinder and said tie-rod is connected rigidly to the rod of one of said first actuator or said second actuator.

9. Method for producing logs of web material, comprising steps of:

winding a predetermined quantity of web material to form a log of web material in a winding cradle, comprising at least one winding roller with moving axis, which is placed in contact with the log being formed and the axis of which moves gradually as the log being formed increases;

unloading the log formed from the winding cradle;

starting to wind a new log in the winding cradle by bringing said winding roller with moving axis in contact with the new log;

wherein movement of the axis of the winding roller is stopped before said predetermined quantity of web material has been completely wound, and winding of the web material is completed while maintaining the winding roller in an essentially fixed position, wherein pressure is applied to the log being formed with said winding roller with moving axis, controlling movement of the axis of said roller by a first actuator; a stroke end position of said first actuator is reached before said predetermined quantity of web material on the log being formed is completed and the winding roller with moving axis is moved away from the log formed by a second actuator.

10. Method as claimed in claim 9, wherein said first actuator and said second actuator are rigidly connected to each other.

11. Method as claimed in claim 9 or 10, wherein said first actuator and said second actuator are linear actuators.

12. Method as claimed in claim 11, wherein said first actuator and said second actuator are piston-cylinder actuators.

13. Method as claimed in claim 12, wherein said first actuator is gradually retracted to a position of maximum retraction; said winding of the web material around the log being formed continues until winding of said predetermined quantity has been completed; the winding roller is moved away from the log formed and the log formed is unloaded from the winding cradle.

14. Method as claimed in claim 12, wherein an essentially constant stress is applied to said log being formed by said winding roller with moving axis until said winding roller reaches said essentially fixed position.

15. Method as claimed in claim 10, wherein an essentially constant stress is applied to said log being formed by said winding roller with moving axis until said winding roller reaches said essentially fixed position.

16. Method as claimed in claim 11, wherein an essentially constant stress is applied to said log being formed by said winding roller with moving axis until said winding roller reaches said essentially fixed position.

17. Method as claimed in claim 11, wherein said first actuator is gradually retracted to a position of maximum retraction; said winding of the web material around the log being formed continues until winding of said predetermined quantity has been completed; the winding roller is moved away from the log formed and the log formed is unloaded from the winding cradle.

18. Method as claimed in claim 17, wherein an essentially constant stress is applied to said log being formed by said winding roller with moving axis until said winding roller reaches said essentially fixed position.

19. Method as claimed in claim 9, wherein an essentially constant stress is applied to said log being formed by said winding roller with moving axis until said winding roller reaches said essentially fixed position.

* * * * *